United States Patent [19]

Kageyama

[11] Patent Number: 4,687,363

[45] Date of Patent: Aug. 18, 1987

[54] MECHANICAL PENCIL AND METHOD FOR ASSEMBLING THE SAME

[75] Inventor: Hidehei Kageyama, Kawagoe, Japan

[73] Assignee: Kotobuki & Co., Ltd., Kyoto, Japan

[21] Appl. No.: 703,921

[22] Filed: Feb. 21, 1985

[30] Foreign Application Priority Data

Jun. 8, 1984 [JP] Japan ..... 59-116683

[51] Int. Cl.[4] ..... B43K 21/24

[52] U.S. Cl. ..... 401/65; 401/53; 401/86

[58] Field of Search ..... 401/65, 67, 94, 85, 401/89, 54, 86, 53

[56] References Cited

U.S. PATENT DOCUMENTS 2,517,297 8/1950 Ferber ..... 401/85
4,247,215 1/1981 Leuthold et al. ..... 401/85
4,358,210 11/1982 Hashimoto et al. ..... 401/65
4,371,277 2/1983 Kageyama et al. ..... 401/54
4,386,865 6/1983 Kageyama et al. ..... 401/67

FOREIGN PATENT DOCUMENTS 34533 7/1965 Finland ..... 401/86

*Primary Examiner*—Steven A. Bratlie
*Attorney, Agent, or Firm*—Sherman and Shalloway

[57] ABSTRACT

A mechanical pencil in which a lead delivery mechanism composed of a lead tank part, a lead chuck, a chuck ring, a sleeve having a stopper and the like is inserted into an outer cylinder having a stopper engaging portion from the rear of the outer cylinder in axially slidable manner, a stopper fitting stepped portion is positioned on the tank part apart from the stopper with a distance equivalent to or shorter than the knocking stroke, and the lead tank part is knocked so that the stopper is fitted to the stopper engaging portion of the outer cylinder, and a method for assembling such mechanical pencil.

4 Claims, 8 Drawing Figures

MECHANICAL PENCIL AND METHOD FOR ASSEMBLING THE SAME

BACKGROUND OF THE INVENTION

1. Field of the Invention

The present invention relates to mechanical pencils assembling efficiency of which can significantly be elevated and to a method for assembling such mechanical pencils. 2. Description of the Prior Art For the sake of simplicity in manufacturing processes and assembling operations for mechanical pencils, such a mechanical pencil wherein a stepped portion or an engaging hole is defined on the inner wall of an outer cylinder, and a part of a lead delivery mechanism is engaged with said portion or hole has recently been proposed. In such conventional mechanical pencils, however, there is such a disadvantage that a thin tubular jig for covering a lead pipe and pushing the stopper is required for assembling a mechanical pencil besides, the assembling work therefor takes much time so that efficiency in assembling such a conventional mechanical pencil is extremely poor.

SUMMARY OF THE INVENTION

The present invention has been made for eliminating the above-mentioned disadvantage involved in conventional mechanical pencils and objects of the present invention are to provide a mechanical pencil which can be easily assembled by such a manner that a stopper fitting stepped portion is defined on a lead tank part at a prescribed position, and a stopper is engaged with an engaging portion formed on its outer cylinder by only knocking the lead tank part as well as a method for assembling such mechanical pencils.

Other objects and advantages of the present invention will be apparent from the following detailed description of embodiments by referring to the accompanying drawings.

DETAILED DESCRIPTION OF THE PREFERRED EMBODIMENTS

The present invention will be described hereinbelow in conjunction with preferred embodiments by referring to the accompanying drawings.

Figure 1:
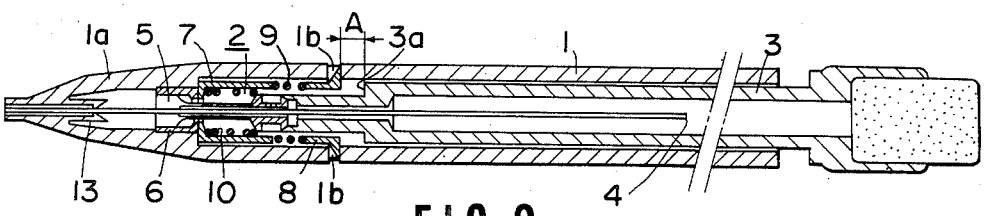
FIG. 1 is a longitudinal sectional view showing a mechanical pencil according to an embodiment of the present invention.
Figure 2:
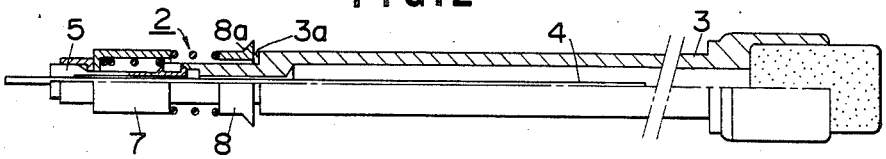
FIG. 2 is a view, partially longitudinal section, of a lead delivery mechanism of the mechanical pencil shown in FIG. 1.
Figure 3:
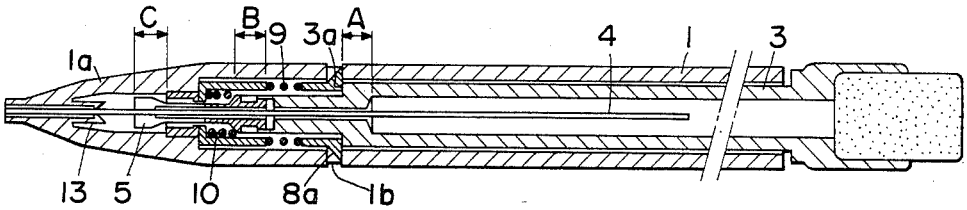
FIG. 3 is a longitudinal sectional view for explaining a state of knocking a lead pipe in a mechanical pencil.

As shown in FIGS. 1 to 3, a stopper engaging hole or stopper engaging portion 1*b* is bored in the wall of a mechanical pencil's outer cylinder 1. Inside the outer cylinder 1, a lead delivery mechanism 2 shown in FIG. 2 is placed by inserting it from the rear end of the outer cylinder 1.

The aforesaid lead delivery mechanism 2 secured to the extreme end of a lead pipe (lead tank part) 3 is provided with a lead chuck 5 for biting a lead 4, a chuck clamp ring 6 being outwardly fitted on a head portion of the lead chuck 5 so as to be axially slidable and functioning for clamping the lead chuck 5, a sleeve 7 abutting on the rear end portion of the chuck clamp ring 6 and restricting axial movement of the chuck clamp ring 6, a stopper 8 engaged with the stopper engaging hole 1*b* of said outer cylinder 1, a first resilient member 9 for cushion mounted resiliently between the stopper 8 and the sleeve 7, and a second resilient member 10 for cushion mounted resiliently between the sleeve 7 and the lead pipe 3.

In the vicinity of the extreme end of said lead pipe 3, a stopper fitting stepped portion 3*a* composing the essential part of the present invention is defined. Because of the provision of the stopper fitting stepped portion 3*a*, there is no need for tools or the like which have been required in prior art in case of fitting the stopper 8 to the stopper engaging hole 1*b*. Furthermore, as shown in FIGS. 1 and 3, a distance A between the stopper fitting stepped portion 3*a* and the stopper 8, a distance B for constraining the second resilient member 10 at the time of knocking the mechanical pencil, and a distance C for forwardly traveling the extreme end of the lead chuck 5 at the time of knocking have such a relationship B and $C \geqq A$ among them, in other words, the distances B and C correspond to a knocking stroke, respectively, and the distance A corresponds to one equivalent to or smaller than the knocking stroke.

According to the above construction, when the lead delivery mechanism 2 is inserted into the outer cylinder 1 and the lead pipe 3 is knocked, an engaging projection 8*a* of the stopper 8 can be positively fitted to the stopper engaging hole 1*b* by means of the stopper fitting stepped portion 3*a* defined on the lead pipe 3.

Next, a method for assembling mechanical pencil according to the present invention will be described hereinbelow.

First, the lead delivery mechanism 2 fixed to the extreme end of the lead pipe 3 is inserted into the rear end of the outer cylinder 1, and the sleeve 7 or the like is allowed to abut against a stepped portion or the like of a tapered end 1*a*. Then, as shown in FIG. 3, when the rear end of the lead pipe 3 is knocked, the lead pipe 3 advances against elastic force of the first and second resilient members 9 and 10 so that the stopper fitting stepped portion 3*a* abuts upon the stopper 8 to push and move it, whereby the engaging projection 8*a* of the stopper 8 is fitted to the stopper engaging hole 1*b* defined on the outer cylinder 1 without requiring any jig or the like to complete assembly of the mechanical pencil.

Thus efficiency in assembling mechanical pencils is significantly improved in accordance with the mechanical pencils and the method for assembling the same of the present invention.

Figure 4:
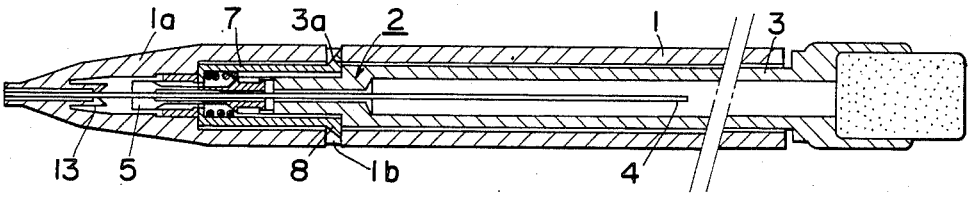
FIGS. 4, 5, 7, and 8 are longitudinal sectional views each showing a mechanical pencil according to other embodiments of the present invention.

FIG. 4 illustrates a mechanical pencil according to another embodiment of the present invention wherein the second cushion resilient member is omitted and the stopper is integrally formed with the sleeve 7, and by which the stopper 8 can be fitted to the stopper engaging hole 1*b* defined on the outer cylinder 1 by means of the stopper fitting stepped portion 3*a* of the lead pipe 3 without requiring any jig or the like as in the case of the above described embodiment. In this case, mechanical pencils are assembled by the same manner as that of the aforesaid embodiment.

Figure 5:
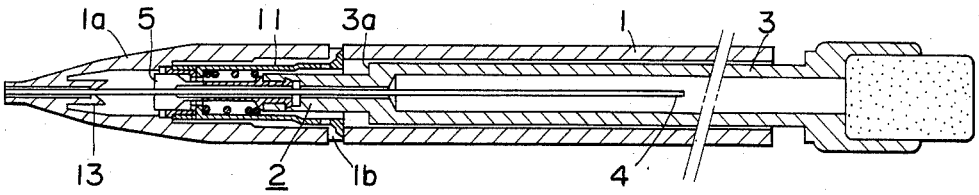
Figure 6:
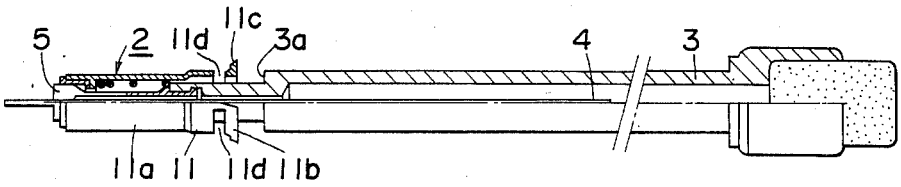
FIG. 6 is a longitudinal sectional view illustrating another modification of the lead delivery mechanism according to the present invention.

FIG. 5 shows a mechanical pencil according to still another embodiment of the present invention wherein such sleeve which is fabricated in the form of a cushion sleeve 11 is utilized and the mechanical pencil is assembled in accordance with the same manner as that of the embodiments described hereinbefore. The aforesaid cushion sleeve 11 is made from a deformable material such as polyacetal or other elastic materials which may be elastically deformed and consists of a sleeve main body 11*a* and a cushion portion 11*b* which is integrally formed with the sleeve main body 11*a* and is axially extendible as shown in FIGS. 5 and 6. The cushion portion 11*b* of the cushion sleeve 11 functions to positively engage an engaging projection 11*c* with the stopper engaging hole 1*b* defined on the outer cylinder 1 as shown in FIG. 6 besides, a plurality of slits 11*d* are bored in the cushion sleeve 11. Because of such construction, the slits 11*d* function as cushion for retracting the lead 4 from an overrun position into the outer cylinder 1 in the case where an excessive writing pressure is applied to the lead 4 at the time of writing. In also the present embodiment, mechanical pencils can be assembled in accordance with quite the same assembling order with those described hereinbefore without requiring any jig or the like.

Figure 7:
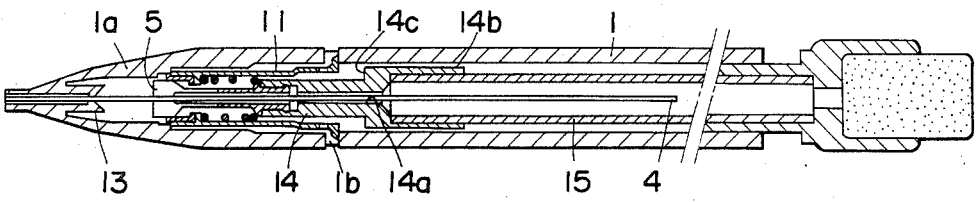

FIG. 7 illustrates a further embodiment according to the present invention wherein the invention is applied to a mechanical pencil of cartridge type. In the present embodiment, a lead guide 14 is firmly fitted to the rear end of the lead chuck 5, and a cartridge 15 functioning as a lead tank part together with the lead guide 14 is detachably attached thereto, i.e., the lead tank part is composed of the lead guide 14 and the cartridge 15.

The aforesaid lead guide 14 is provided with a lead delivery passage 14*a* for delivering only one writing lead 4 to the lead chuck 5. Furthermore a fitting hole 14*b* having substantially same diameter with the inner diameter of the outer cylinder 1 and for fitting the cartridge 15 is defined on a fitting part aligned with the lead delivery passage 14*a*. In addition, a stopper fitting stepped portion 14*c* is also defined on the lead guide 14 at the same prescribed position as those of the above-mentioned embodiments.

In accordance with the present embodiment, therefore, such a mechanical pencil of cartridge type wherein the engaging projection 11*c* of the cushion sleeve 11 can positively be fitted to the stopper engaging hole 1*b* by means of the stopper fitting stepped portion 14*c* defined on the lead guide 14, when the cartridge 15 is knocked as in the case of the aforementioned embodiments is obtained.

Figure 8:
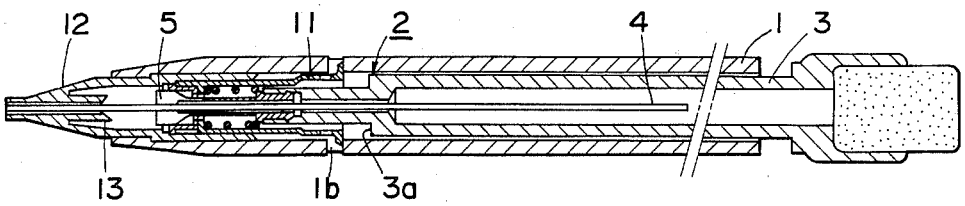

FIG. 8 shows a mechanical pencil according to still another embodiment of the present invention wherein the outer cylinder 1 is separately formed from the tapered end 12, and this tapered end 12 may be incorporated into the outer cylinder 1 together with the cushion sleeve 11 by means of forward pressure due to the stopper fitting stepped portion 3*a* defined on the lead pipe 3. In also the present embodiment, the lead delivery mechanism 2 the extreme end of which is fitted with the tapered end 12 is inserted into the outer cylinder 1 in accordance with the same manner as those of the aforementioned embodiments, and then the lead pipe 3 is knocked so that assembly of the mechanical pencil is completed.

In the above respective embodiments, while the stopper 8 or 11*c* is fitted to the stopper engaging hole 1*b* by means of the stopper fitting stepped portion 3*a* (or 14*c*) defined integrally on the lead pipe 3 or the lead guide 14, the present invention is not limited thereto, but the stopper fitting stopped portion may be replaced by any means such as a stepped portion formed by securing a ring on the lead pipe 3 or the like so far as the stopper 8 or 11*c* can positively be fitted to the stopper engaging hole 1*b* by such means described herein.

Furthermore, in the above embodiments, although a lead holding portion 13 is integrally formed with the tapered end 1*a* or 12, the present invention is not limited thereto, but rather, the lead holding portion 13 may be separately formed from the tapered end, or alternatively a rubber packing or the like may be interposed therebetween.

Moreover, while the stopper 8 is engaged with the outer cylinder 1 by means of the stopper engaging hole 1*b* in the above embodiments, this invention is not limited thereto, but the stopper 3 may be engaged with a stepped portion or the like.

As mentioned hereinbefore, according to the present invention, a lead delivery mechanism is inserted into an outer cylinder, and then a lead tank part having a stopper fitting stepped portion defined at a prescribed position is knocked, so that a stopper is pushed to be engaged with the outer cylinder, whereby assembly of a mechanical pencil is completed, and hence the present invention can provide very excellent advantages such as significantly improved efficiency in assembling mechanical pencils and the like.

What is claimed is:

1. A mechanical pencil comprising:

an outer cylinder having a stopper engaging portion;

a lead tank part placed inside said outer cylinder so as to be axially slidable;

a lead chuck fitted to the extreme end of said lead tank part;

a chuck clamp ring disposed in a chuck portion of said lead chuck;

a first sleeve provided with a stopper portion for engaging with the stopper engaging portion of said outer cylinder and loosely fitted to said lead chuck at the rear of said chuck clamp ring; a second sleeve abutting on a rear end portion of said chuck clamp ring and biasing means interposed between said second sleeve and said lead tank part; and a stopper fitting stepped portion defined on said lead tank part at a position apart from said stopper portion with a distance A said biasing means being compressible through a distance B and said lead chuck being movable a distance C, the distances B and C corresponding to a knocking stroke and the distance A being less than or equal to a knocking stroke.

2. A mechanical pencil as claimed in claim 1 wherein said lead tank part is composed of an exchangeable cartridge and a lead guide for detachably attaching said cartridge, and said stopper fitting stepped portion is defined on said lead guide.

3. A method for assembling a mechanical pencil comprising the steps of forming a lead delivery mechanism by filling up slips or the like defined by a lead tank part, a lead chuck, a chuck clamp ring, and a stopper, inserting said lead delivery mechanism into an outer cylinder from the rear end opening thereof, said lead tank part having a stopper fitting stepped portion defined at a position apart from the stopper of said lead delivery mechanism with a distance A equivalent to or shorter than the knocking stroke, said stopper being engaged with a stopper engaging portion of said outer cylinder; said method further including the steps of:

(a) providing a sleeve abutting on a rear portion of said chuck clamp ring;

(b) interposing biasing means between said sleeve and said lead tank part;

(c) limiting the movement of said biasing means to distance B;

(d) limiting the movement of said lead chuck to a distance C;

(e) said distances B and C corresponding to the knocking stroke.

4. A method for assembling a mechanical pencil as claimed in claim 3 wherein a tapered end part is separately manufactured from said outer cylinder and said tapered end part is fitted into the rear end of said outer cylinder before said lead delivery mechanism is inserted into said outer cylinder.

* * * * *